US006655400B2

(12) United States Patent
Cho

(10) Patent No.: US 6,655,400 B2
(45) **Date of Patent: *Dec. 2, 2003**

(54) HEIGHT-ADJUSTING MEDICAL CRUTCH

(76) Inventor: Kyungil Cho, #708, 504-dong Somanmaeul, #788, Hangshin-dong, Dukyang-ku, Koyang-city, Kyungkido (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/390,665

(22) Filed: Sep. 7, 1999

(65) Prior Publication Data

US 2001/0054434 A1 Dec. 27, 2001

(30) Foreign Application Priority Data

Sep. 11, 1998 (KR) ..... 1998-017329

(51) Int. Cl.[7] ..... A61H 3/02
(52) U.S. Cl. ..... 135/68
(58) Field of Search ..... 135/65–77

(56) References Cited

U.S. PATENT DOCUMENTS 683,568 A * 10/1901 Moore ..... 135/68
1,035,760 A * 8/1912 Walton ..... 135/68
2,264,015 A * 11/1941 Bennett ..... 135/68
2,426,074 A * 8/1947 Watters ..... 135/68
2,554,653 A * 5/1951 Wisecarver ..... 135/68
3,492,999 A * 2/1970 Boyd ..... 135/68
3,730,198 A * 5/1973 Johnston et al. ..... 135/68
4,721,125 A * 1/1988 Wang-Lee ..... 135/69
RE32,815 E * 1/1989 Smith ..... 135/69
4,865,065 A * 9/1989 Chen ..... 135/69
4,872,469 A * 10/1989 Schultz ..... 135/69
4,979,533 A * 12/1990 Hansen et al. ..... 135/69
5,025,820 A * 6/1991 Gamper ..... 135/69
5,341,829 A * 8/1994 Hsiao et al. ..... 135/68
5,351,701 A * 10/1994 Hsiao ..... 135/68
5,402,811 A * 4/1995 Weng ..... 135/68
5,445,175 A * 8/1995 Cho ..... 135/68
5,605,170 A * 2/1997 Weng ..... 135/68
5,765,583 A * 6/1998 Gamper ..... 135/68
5,901,724 A * 5/1999 Andrea et al. ..... 135/69

* cited by examiner

*Primary Examiner*—Bruce A. Lev
*Assistant Examiner*—Jennifer E. Novosad
(74) *Attorney, Agent, or Firm*—Whitham, Curtis & Christofferson, P.C.

(57) ABSTRACT

A height-adjusting medical crutch having a fixed globe (6) whose center is penetrated so that a middle bottom frame (4) can pass therethrough, a side frame (8), a rivet (10) which fixes a fixed globe (6) on a lower part of the side frame (8) and the middle bottom frame (4) which is moved through the inner side of the fixed globe (6) so that the height of the medical-adjusting crutch can be adjusted. A tight coupler (12) having an arc form is formed continuously on the inner radial surface,of the fixed globe (6) so that the tight coupler (12) adheres to the space between the middle bottom frame (4) and the side frame (8). A side frame (8*a*) is penetrated to be inserted into both sides of the inner radial surface of the fixed globe (6*a*) and the side frame (8*a*) is fixed on the upper edge and lower edge of the medical crutch.

8 Claims, 4 Drawing Sheets

HEIGHT-ADJUSTING MEDICAL CRUTCH

BACKGROUND OF THE INVENTION

1. Field of the Invention

This invention relates to a medical crutch, and more particularly to a height-adjusting medical crutch and, more particularly, to a medical crutch providing increased ease of height adjustment without compromise of stability or rigidity.

2. Discussion of Related Art

Figure 5:
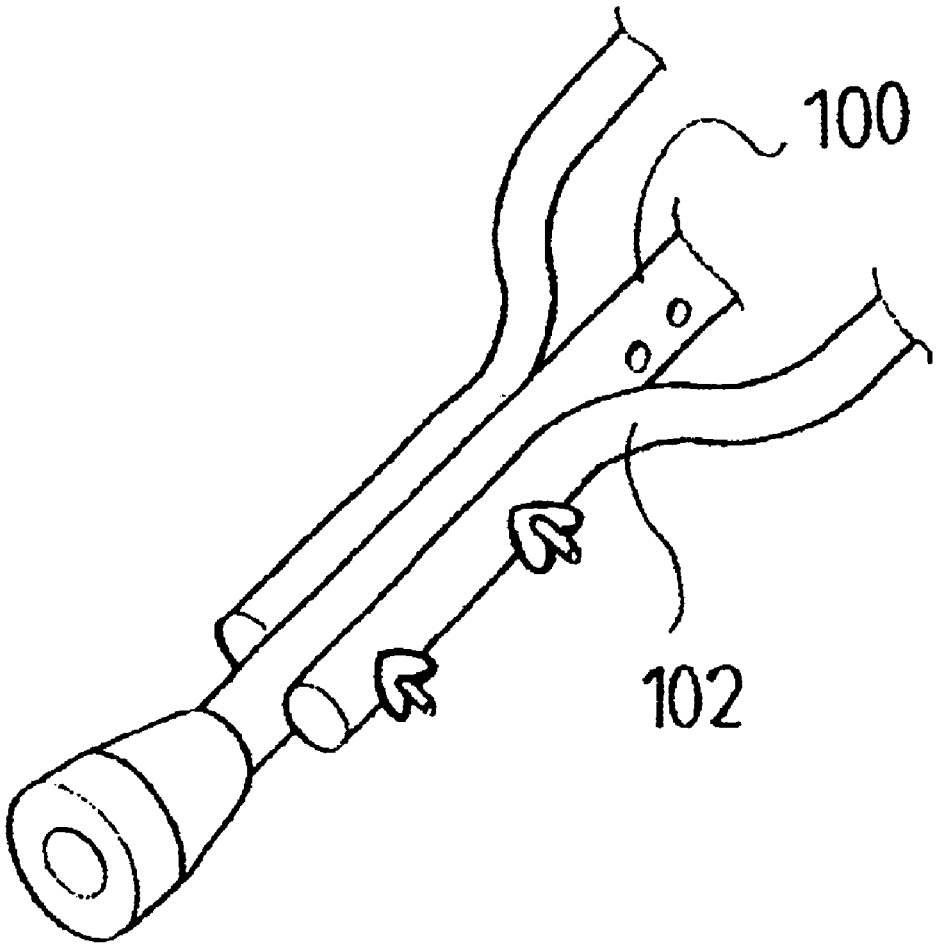
FIG5 PRIOR ART

In conventional medical crutches as shown by FIG. 5 attached, side frames 102 which are made of aluminum tubes, which is light in weight and has good working properties, are formed at the light and left sides of a middle bottom frame 100 and are fixed in a two-dot method by using two screw bolts and nuts for the top and bottom positions where a middle bottom frame 100 and side frames are brought together.

The conventional configuration, which is configured. as described above, controls the length of a medical crutch in a way to move a middle bottom frame 100 up and down by removing two screw bolts and nuts when adjusting the height of the medical crutch. However, it is inconvenient for a patient to use such a height adjusting feature as this method is somewhat complex.

Figure 6:
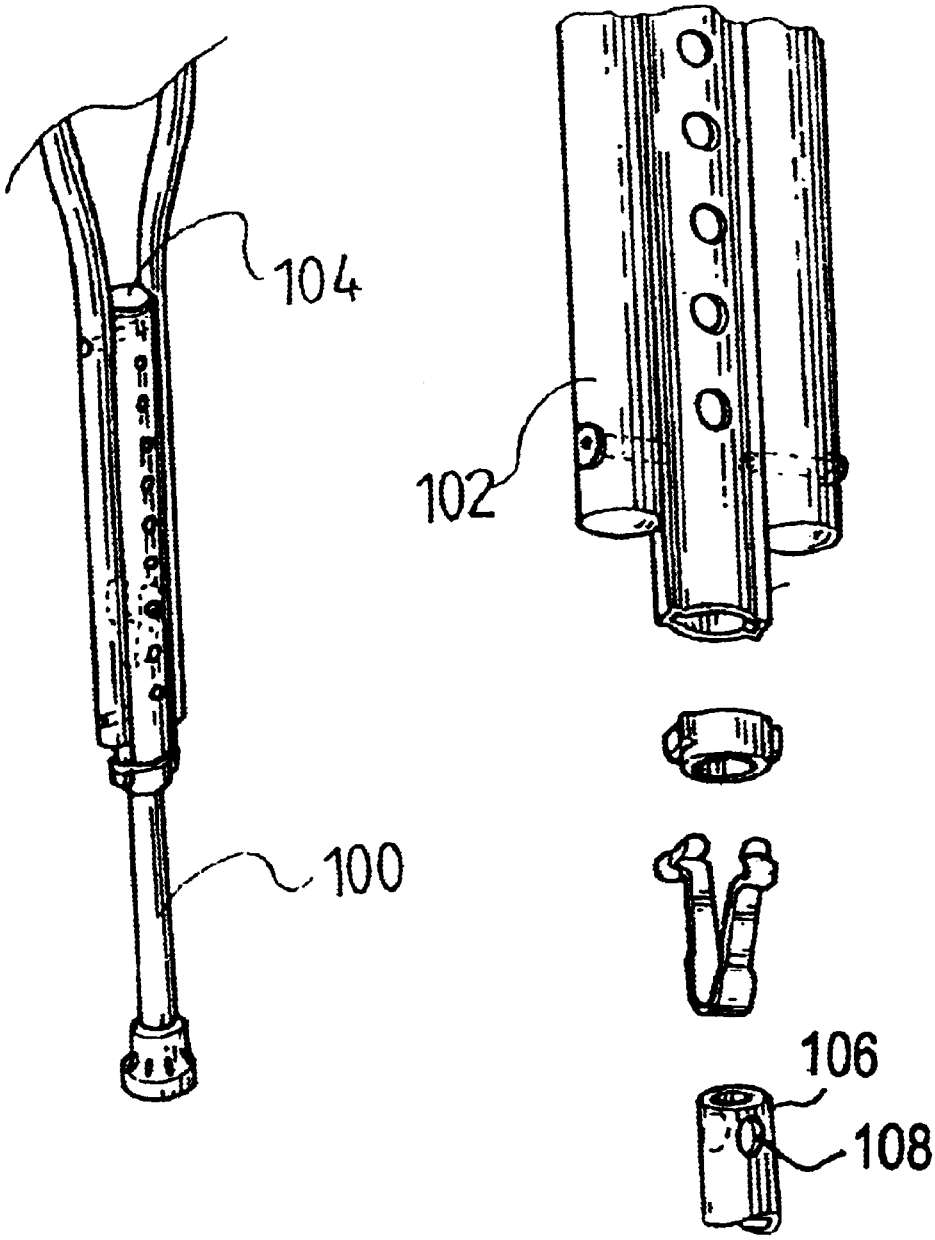
FIG6 PRIOR ART

In order to solve the above inconvenience, recently the push-button type of medical crutch has been proposed as shown in FIG. 6. The height adjustment method thus provided is that a rather small fixed tube 104 is fixed into the inner side of side frames 102 which are configured on the right and left side thereof, so that at the time of using the medical crutch, the middle bottom frame 100 can be moved up and down in the inner space of the tube 104. This method has a problem in that the medical crutch is not rigid and its stability is reduced when a patient uses the crutch because, when the medical crutch is maximized in length, bearing surface is small since the length of a middle bottom frame 100 is moved up and down only in the inner side of a small fixed tube 104 at the time of controlling the length of a medical crutch.

Also, in case that while the middle bottom frame 100 is moved up and down in the inner space of the tube 104 in order to adjust the length of a medical crutch, and in this regard the clearance between a tube and a tube becomes small or binds, the moving operation of a middle bottom frame 100 becomes difficult. Therefore in order to adjust the length of a middle bottom frame, it is necessary to insert the middle bottom frame 100 by maintaining appropriate clearance for moving bottom frame 100 up and down. In this regard, because of this clearance, the middle bottom frame 100 is not rigidly supported and its stability is reduced.

Also in the method of the up and down moving adjustment of a middle button frame 100 and of fixing it, there is another problem compromising a patient's safety in that a button part falls into a hole because of its weight at the time of use since a middle bottom frame 100 is fixed relying only on the button part, which is installed on a middle button frame, and is only held in place by protrusion into the hole 108 which is punched on the fixed tube 106.

SUMMARY OF THE INVENTION

Accordingly, in order to overcome such drawbacks in the conventional art, it is therefore an object of the present invention to provide a medical crutch, wherein a fixed globe is installed on a connecting part of a middle bottom frame and side frames, which allows the middle bottom frame to be moved up and down while the middle bottom frame is tightened solidly in the inner side of the fixed globe while allowing adjustment of the height of a medical crutch easily.

It is another object to provide a medical crutch which can be used more safely by mounting a fixed globe in one-dot or two-dot method even for conventional bolt or push button type of medical crutch.

To achieve these and other advantages and in connection with the purpose of the present invention, as embodied and broadly described, there is provided a height-adjusting medical crutch comprising a fixed globe 6, wherein its center is penetrated, forming an aperture so that a middle bottom frame 4 may go in and out, a side frame 8, a rivet 10, by which the fixed globe 6 is fixed on lower part of the side frame 8 and a middle bottom frame 4, which is moved through the inner side of the fixed globe 6, so that the height of said medical-adjusting medical crutch may be easily adjusted.

According to another aspect of the present invention, there is also provided a height-adjusting medical crutch, wherein a tight coupler 12 having an arcuate form is formed continuously on the inner radial surface of the fixed globe 6 and the tight coupler 12 adheres to space between the middle bottom frame 4 and the side frame 8.

According to still another aspect of the present invention, there is also provided a height-adjusting medical crutch, wherein a side frame 8*a* is penetrated to be inserted into both sides of the inner radial surface of the fixed globe 6*a* and the side frame 8*a* is fixed on the higher edge and lower edge of the medical crutch.

According to still another aspect of this invention, there is also provided a height-adjusting medical crutch, wherein a fixed globe, which is formed in a rounded style in the shape of inner radial surfaces according to the medical crutch having the form of arcs and/or angles in this invention, is made to be fixed on the side frames in a way that the middle bottom frame can be moved up and down.

BRIEF DESCRIPTION OF THE ATTACHED DRAWINGS

Figure 1:
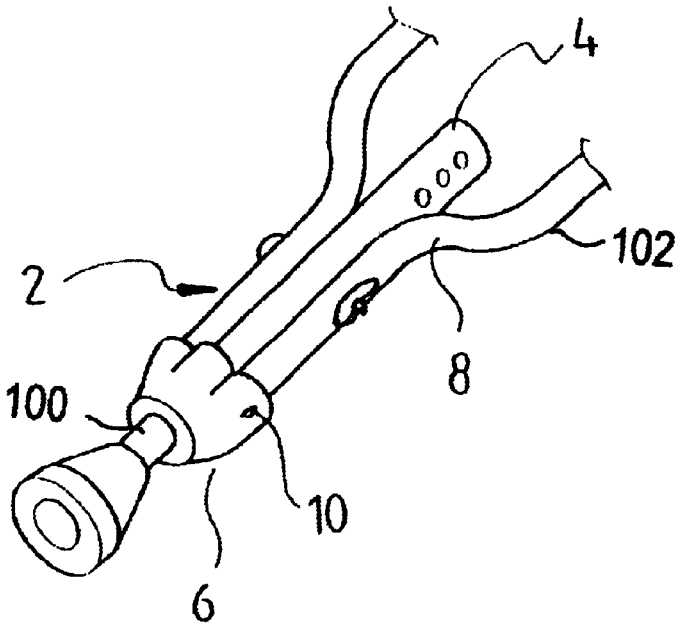
Figure 2:
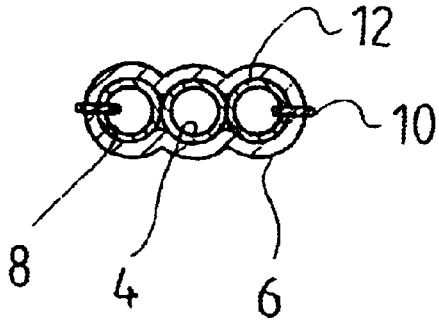
Figure 3:
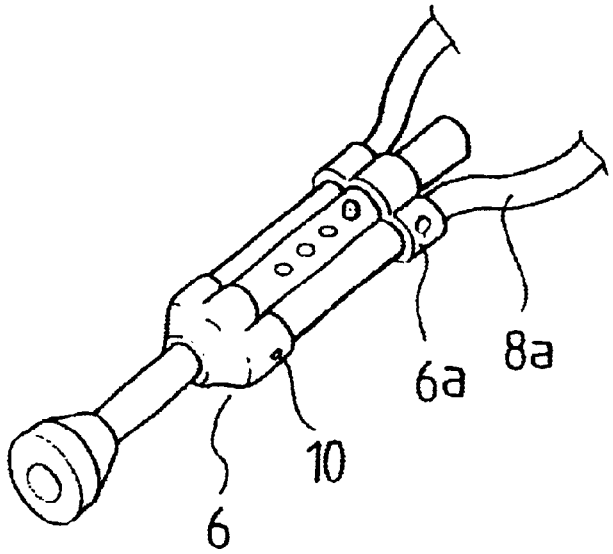
Figure 4:
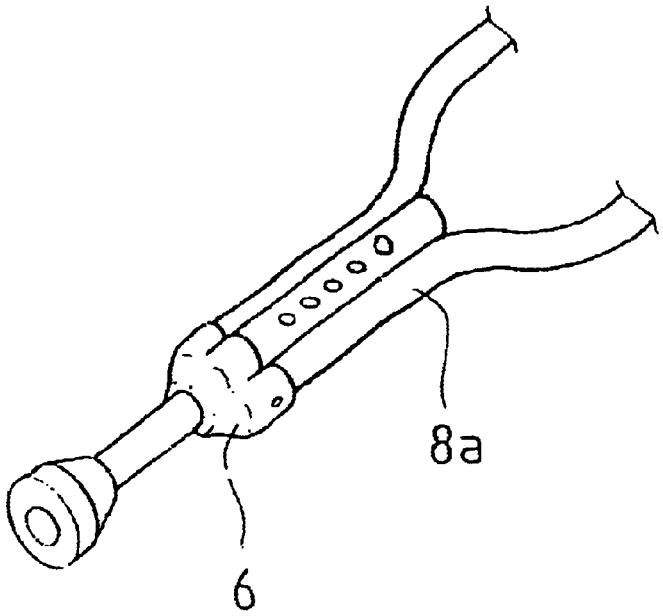

A more complete appreciation of the invention, and many of the attendant advantage thereof, will be readily apparent as the same becomes better understood by reference to the following detailed description when considered in connection with the accompanying drawings in which like reference symbols represent the same or similar components, wherein:

FIG. 1 is a perspective view according to an embodiment of this invention,

FIG. 2 is a cross sectional view of a globe in accordance with the invention, FIG. 3 is a perspective view according to another embodiment of this invention, FIG. 4 is a perspective view according to still another embodiment of this invention, FIG. 5 is a perspective view of a screw bolt type of conventional medical crutch , FIG. 6 is a perspective view of button type of conventional medical crutch.

DETAILED DESCRIPTION OF PREFERRED EMBODIMENT

From the following, the most desirable embodiment of this invention will be described in detail according to the attached drawings. The same reference number will be used to mean the same drawing elements regardless of different drawings.

As shown in FIGS. 1 through 4, in a conventional medical crutch, which is made to be fixed in a two-dot method, in which a screw bolt and a nut are used on parts which confront a middle bottom frame 100 and a side frame 102 by using an aluminum tube, the configuration of this embodiment of the invention is that a middle bottom frame 4 is fixed in a globe 6 on the lower part of side frames 8 by a rivet 10 so that a middle bottom frame 4 may enter the center of the fixed globe 6; which is formed integrally in a configuration which includes continuous arcs and/or angles on an inner radial surface according to the configuration of a middle bottom frame 4 and side frames 8 which forms a medical crutch 2.

The above described inner radial surface is made to have a tight coupler 12 formed continuously in arcs. When an aluminum tube is used for the tight coupler 12, it extends into the space around the middle bottom frame 4 and side frames 8, so that the middle bottom frame 4 is fixed solidly.

Also, the above fixed globe 6 should not have elasticity and is made integrally of a material which does not easily break, so it can fix the middle bottom frame 4 and side frames 8 solidly.

FIG. 3 and FIG. 4 are the other embodiments of this invention. If the side frames 8a pass through the lower part, inserted into the inner radial surface of the fixed globe part 6*a* and fixed by a rivet 10 on the higher and lower part of side frame 8*a* of the medical crutch 2*a*, wherein a well known conventional push button is mounted, a user can use the medical crutch, safely even in the case the middle bottom frame 4 is fully extended at the time of using the push button type of medical crutch.

Also, if the middle bottom frame 4 is made to be moved in the tube by making the middle bottom frame 4 extended and it is supported over a constant distance, the stability of a medical crutch can be maximized.

The effect of this invention configured as discussed above is that the manufacturing of a medical crutch is simplified because an arcuate tight coupler 12 is formed integrally according to the figures with the a middle bottom frame 4 and a side frame 8 which are made of the material which does not break easily, while the middle bottom frame 4 is inserted into its center to be able to be moved and the fixed globe 6 is formed integrally with them.

The fixed globe 6 is fixed on the side frame 8 solidly if the fixed globe 6, which is manufactured as described above, is fitted to the lower edge of the side frame 8, 8*a*, corresponding to the lower end of a push button type of medical crutch or conventional well-known two-dot bolt type of medical crutch, and is fixed by a rivet 10.

If the middle bottom frame 4 is inserted into the center of the fixed globe 6 after completing the fixed globe 6, the middle bottom frame 4 is located in the inner side of the side frame 8 a and V-type of space is made at the contacting locations. In this case, the middle bottom frame 4 and side frames 8 are tightened solidly because the tight coupler 12 which is formed in the inner side of the fixed globe 6 is tightened in the space.

At the state that the middle bottom frame is inserted as the above, the fixing operation, which fixes the middle bottom frame 4 on the side frame 8, is completed if a screw bolt and a nut is fixed on the higher part.

Accordingly, through the operation that tightens and loosens a screw bolt and a nut which are configured in conventional two-dot type, the middle bottom frame 4 can be fixed easily, not because of the operation that fixes the middle bottom frame 4, but because of the operation that tightens and loosens only one locking bolt by moving the middle bottom frame 4 through the inner side of the fixed globe 6. In this case, not only is it possible to perform the fixing operation more simply, but also the middle bottom frame 4 and side frames 8 can be fixed solidly since the tight coupler 12 is located in the space between the globe and frame members when the middle bottom frame 4 and the side frame 8 is tightened.

Also, at the time that the conventional push button type of medical crutch is applied, if the fixed globe 6 is fitted onto the higher part and lower part of the side frame 8*a* as described above, and is fixed by a rivet 10, the inner tight coupler of the fixed globe 6 is tightened on the middle bottom frame 4 and the side frame 8, so that the middle bottom frame 4 can be fixed solidly, and so that the stability of the medical crutch can be maximized and motion within the medical crutch avoided.

Also, if the fixed globe parts 6, 6*a* are fixed on the higher part and lower part of a medical crutch, respectively, by using the fixed globe 6*a*, in which both sides of inner radial surface areas penetrated, and the middle bottom frame 4 is extended, this invention is safer than the push button type of medical crutch because the bottom frame 4 is supported for a constant length.

Also, at the time of using a medical crutch, this invention is much safer than the conventional medical crutch when walking because the lower edge of the middle bottom frame 4 is tightened solidly in the inner side of the fixed globe 6.

As described the above, this invention has a good effect in that not only the fixing operation of a medical crutch is easy, but also the height of a medical crutch is quickly and easily adjusted because a fixed globe, which forms inner radial surface corresponding to the figures of a middle bottom frame and a side frame, is installed to be fixed on a side frame.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A height-adjusting medical crutch comprising:

a fixed globe having a center opening and an inner surface;

a side frame including a tube;

a rivet fixing said fixed globe on a lower part of said side frame;

a middle bottom frame, movable through said center opening of said fixed globe and having an upper portion thereof supported relative to said side frame by one of a single bolt and a height-adjusting tube for adjusting height of said height adjusting medical crutch, said height adjusting tube being attached to said side frame and supporting said middle bottom frame over a constant length; and means located within said fixed globe for fixing said side frame rigidly against one of said middle bottom frame and said height-adjusting tube, respectively, by conforming to and extending partially between said side frame and said one of said middle bottom frame and said height-adjusting tube, respectively.

2. A height-adjusting medical crutch as claimed in claim 1, wherein said means for fixing comprises a tight coupler having an arcuate form which is formed on an inner radial surface of said fixed globe and said tight coupler extends into spaces between said middle bottom frame and said side frame within said fixed globe.

3. A height-adjusting medical crutch as recited in claim 2, wherein said tight coupler is formed continuously on said inner radial surface of said fixed globe.

4. A height adjusting crutch as recited in claim 2, further including a fixed globe part separated a distance from said fixed globe and supporting an upper end of said height adjusting tube against said side frame.

5. A height-adjusting medical crutch as recited in claim 1, wherein said side frame tube is an aluminum tube.

6. A height adjusting crutch as recited in claim 1, further including a fixed globe part separated a distance from said fixed globe and supporting an upper end of said height adjusting tube against said side frame.

7. A height-adjusting medical crutch comprising:

a fixed globe having a center opening and an inner surface;

a side frame including a tube;

a rivet fixing said fixed globe on a lower part of said side frame;

a middle bottom frame, movable through said center opening of said fixed globe and having an upper portion thereof supported relative to said side frame by a single bolt for adjusting height of said height-adjusting medical crutch; and means located within said fixed globe for fixing said side frame rigidly against said middle bottom frame by conforming to and extending partially between said side frame and said middle bottom frame.

8. A height-adjusting medical crutch comprising:

a fixed globe having a center opening and an inner surface;

a side frame including a tube;

a rivet fixing said fixed globe on a lower part of said side frame;

a middle bottom frame, movable through said center opening of said fixed globe and having an upper portion thereof supported relative to said side frame by a height-adjusting tube, said height adjusting tube being attached to said side frame and supporting said middle bottom frame over a constant length, for adjusting height of said height-adjusting medical crutch; and means located within said fixed globe for fixing said side frame rigidly against said height-adjusting tube by conforming to and extending partially between said side frame and said height-adjusting tube.

* * * * *